United States Patent [19]

Nenkov

[11] Patent Number: 4,497,382

[45] Date of Patent: Feb. 5, 1985

[54] RETRACTABLE CORE DRILL BIT

[75] Inventor: Nikolay D. Nenkov, Sofia, Bulgaria

[73] Assignee: Komitet po Goelogica, Sofia, Bulgaria

[21] Appl. No.: 478,486

[22] Filed: Mar. 24, 1983

[51] Int. Cl.[3] ..... E21B 10/64

[52] U.S. Cl. ..... 175/260; 175/284

[58] Field of Search ..... 175/258–260, 175/270, 271, 273, 284–287, 290

[56] References Cited

U.S. PATENT DOCUMENTS

| | | | |
|---|---|---|---|
| 2,764,388 | 9/1956 | Camp | 175/259 |
| 2,982,366 | 5/1961 | Camp et al. | 175/259 |
| 3,661,219 | 5/1972 | Okuyama et al. | 175/260 |

*Primary Examiner*—Stephen J. Novosad
*Assistant Examiner*—Thuy M. Bui

[57] ABSTRACT

Retractable core drill bit having a hollow cylindrical body at its lower end to which a monolith core drill bit is screwed. A stop sleeve is provided on the upper end of the hollow cylindrical body, and cutting components are pivotally mounted in the middle of the body. There is a spacer in the body having an end piece on its upper end around which there is driven a guiding sleeve resting on a stop sleeve which is surrounded by a outer end piece and an outer tube. There are longitudinal slots in the body for the radial movement of the cutting components which are disposed opposite to each other in interperpendicular planes.

1 Claim, 4 Drawing Figures

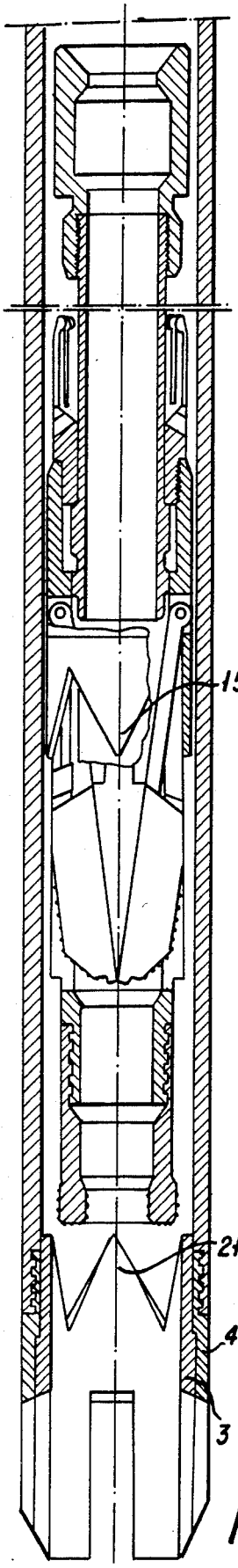
Fig. 1
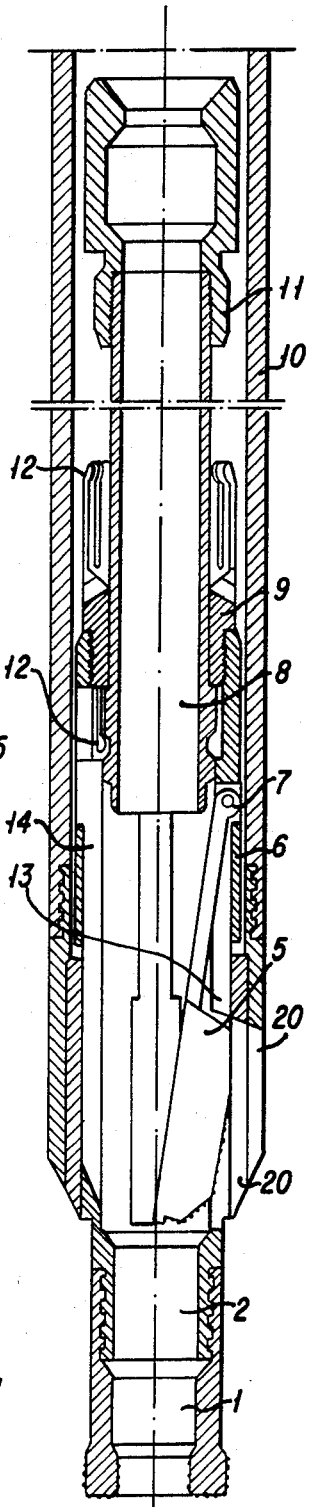
Fig. 2/1
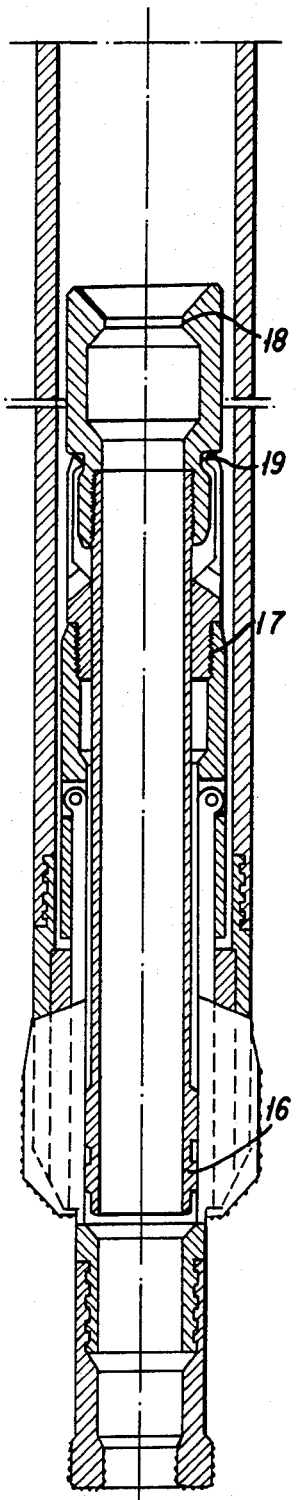
Fig. 3/2
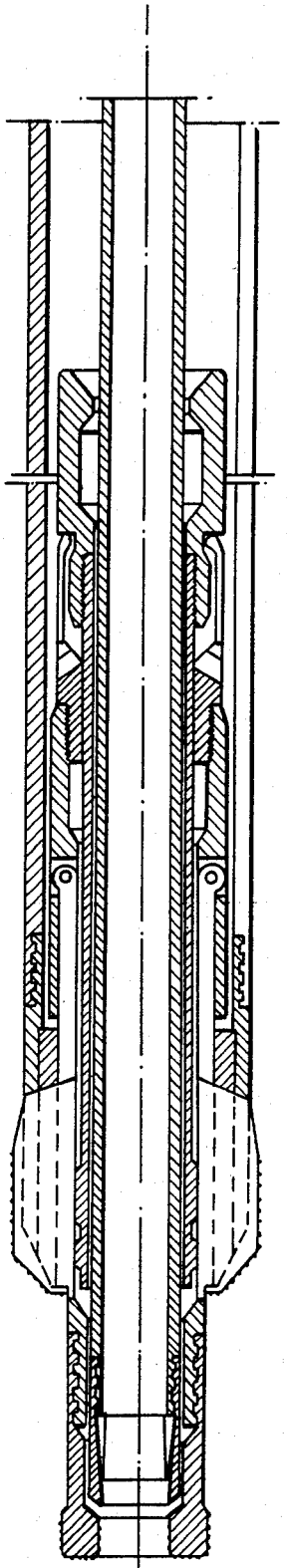
Fig. 4

RETRACTABLE CORE DRILL BIT

This invention relates to a retractable core drill bit used for geological prospecting drilling.

A retractable core drill bit consisting of an external tube wherein the core-receiving tube is situated having a unitary core drill bit screwed on its lower end is well known. The device for fixing to the overshot is situated on the top end of the core-receiving tube, and cutting components fixed to the outer tube are fitted above the core drill bit.

The disadvantages of the well-known drill bit consist of the following:

The drill bit cannot be used independently as it is integral with the retractable core-receiving tube, and the core drill bit has to be removed every time a core is removed on the surface of the earth and this has a bearing on its mechanical integrity; the diameter of the removed core is quite small, and the components of the structure are not protected from abrasive wear.

The present invention has among it objects the provision of a retractable core drill bit which can operate separately, regardless of the retractable core-receiving tube, and which guarantees the formation of a large-diameter core.

In accordance with the present invention a retractable core drill bit is provided consisting of a hollow cylindrical body to the top part of which a one-part core drill bit is screwed, and a locking nut to the top end, the middle of the body having fixed cutting components having the ability to revolve around axes. In the body there is a spacer the upper part of which is connected to an end piece, and a guiding sleeve thrust on its outer end resting on a stop sleeve which in its turn is enveloped by an outer end piece and an outer tube. In the body there are longitudinal slots for the radial removal of the cutting components, the slots being fixed one against another in planes which are disposed perpendicular to each other. Both ends of the locking nut have the shape of a collet.

The advantages of the retractable core drill bit according to the invention are the following: the drill bit can operate separately and independently from the retractable core-receiving tube; it guarantees the formation of large-diameter cores; it has a double securing system which does not permit any self-actuation and self-release of the core drill bit and the retractable drill bit; it enables the use of a standard overshot structure; the cutting components have inner clamping, thus protecting them from damage.

A preferred embodiment of the device of the invention is illustrated in the accompanying drawings, wherein:

FIG. 1 is a vertical sectional view of the retractable core bit shown in its condition the the time of transport;

FIG. 2 is a view similar to FIG. 1 wherein the retractable core bit is shown in its condition just before the working condition;

FIG. 3 is a view similar to FIG. 2 wherein the retractable core bit is shown in its working condition; and FIG. 4 is a view similar to FIG. 3 wherein te retractable core tube is shown in its lowered condition when the retractable core bit is in its working condition.

The retractabe core drill bit according to the invention has a hollow cylindrical body 2 in the form of a sleeve having lower and inner surfaces shaped in steps. To the outer end of the hollow cylindrical body 2 there is screwed a unitary core drill bit 1, and a locking pin 9 is fixed to its upper end, both ends of the locking pin 9 being in the shape of a collet 12. Slots 13 are formed along the generatrix in the middle of the hollow cylindrical body 2. Cutting components 5 pivotally mounted upon axes 7 inside the hollow cylindrical body 2 are fitted in slots 13. Canals 14 of the washing system of the drill bit are formed among the cutting components 5. A guiding sleeve 6 serving for orientation, the front part of which has triangular slits 15, is driven onto the hollow cylindrical body 2. Spacer 8 is fitted inside the body 2, a core-receiving tube (not shown) being inserted into such spacer. Spacer 8 is a tube in the lower part of which two rings 16 are provided along its outer cylindrical surface; rings 16 have outer diameters which are greater than those of spacer 8 and are mounted one on top of the other; on the top side of spacer 8 there is an external thread 17 to which an end piece 11 is screwed. The end piece 11 is a cylindrical bushing in the lower internal side of which there is a thread, and on the top side of which there is a tapered collet 18. On its outer surface of the end piece 11 is smooth, and the end piece 11 in its lower end has a profile canal cut 19.

The hollow cylindrical body 2 together with the cutting components 5 mounted upon it are housed in an external end piece 4 which is fixed to a stop sleeve 3 and an external tube 10 which is an element of the drilling rod. The connection between the external end piece 4 and the external tube 10 is threaded. The two components: the external end piece 4 and the stop sleeve 3, in their lower parts are cut by slots 20 forming a bed for the cutting components 5. The upper end of the end piece 4 ends in a thread, and the stop sleeve ends in slits 21, the number of slits 21 corresponding to and having the same shape as the slits of the guiding sleeve 6.

The retractable core drill bit according to the invention operates as follows in the following stages of operation: (1) state of transport when dropped in the drilling rod; (2) operating state when the core is formed; and (3) state of transport when being removed from the borehole.

(1) When the retractable core drill bit is in the state of transportation for being dropped in the drilling rod, the end piece 11 together with spacer 8 are pulled to a top end position. The end of the lower collet part 12 of the securing (locking) nut 9 fall in the canal formed between the two rings 16 of spacer 8 fixing it in a stationary position toward the hollow cylindrical body 2. In this position the lower part of spacer 8 is above the cutting components 5. The latter can freely retract to the hollow cylindrical body 2, and in this way the drill bit is ready to be dropped in the drilling rod.

(2) The retractable core drill bit is automatically turned into its vertical operating position, shown in FIGS. 1 and 2. The retractable core drill bit dropped in the drilling lever after reaching the stop sleeve 3 comes into contact with it by means of slits 21 of the guiding sleeve 6. After the slits 21 of the stop sleeve 3 in the guiding sleeve 6 fully mesh, the retractable drill bit discontinues its movement when the cutting components 5 are oriented against the slots 20. At the same time, spacer 8 and end piece 11 connected to it continue their travel downwardly under the effect of the kinetic energy in them. Spacer 8 by its lower part pushes the cutting components 5 in a radial direction so that they take up their operating positions. At the same time, the end of the upper collet part 12 of the locking nut 9 comes into the profile canal 19 of end piece 11, and in this way spacer 8 is locked in an end power position. The retractable core drill bit is now ready for operation. The torque and the axial load are transmitted by means of the outer end piece 4 and stop sleeve 3 to the cutting components 5, and the latter to drill bit 1 by means of the hollow cylindrical body 2. The retractable core drill bit goes back to its transportation position at the end of the drilling operation, so as to be removed from the borehole.

(3) Pulling up of the spacer 8 is by means of the overshot dropped into the drilling rod which clamps to end piece 11. The upper collet end 12 of locking nut 9 frees the end piece 11 and in this way the clamping device is released. Spacer 8 continues its movement upwardly until the lower collet part 12 of the stop nut 9 is actuated. This releases the cutting components 5, and under the effect of a tension force they are retracted back to the hollow cylindrical body 2. The retractable core drill bit is then ready to be taken out back to the surface of the earth.

Although the invention is described and illustrated with reference to a single preferred embodiment thereof, it is to be expressly understood that it is in no way limited to the disclosure of such preferred embodiment but is capable of numerous modifications within the scope of the appended claims.

I claim:

1. In a retractable core drill bit having an upper end and a lower end, said drill bit containing an outer tube and a unitary core drill bit fitted to the lower end of the outer tube, above said unitary core drill bit there being affixed to the outer tube cutting components, the improvement which comprises a hollow cylindrical body housed within the outer tube, the unitary core drill bit being screwed to the lower end of said hollow cylindrical body and a strip nut being affixed to the upper end thereof, said stop nut having its both ends in the form of opposite chucks, wherein the middle of the hollow cylindrical body there are pivotally attached said cutting components and longitudinal slots are formed between these cutting components, inside the hollow cylindrical body there being a spacer the upper portion of which is connected to an end piece and the hollow cylindrical body being enveloped by a guiding sleeve which is in contact with a supporting sleeve enveloped by an external end piece in which the cutting components are affixed in slots positioned one opposite the other in planes which are disposed perpendicular to each other on the lower end of the hollow cylindrical body.

* * * * *